US009416554B2

(12) United States Patent
Wastel

(10) Patent No.: US 9,416,554 B2
(45) Date of Patent: Aug. 16, 2016

(54) VEHICLE PARKING WITH AUTOMATED GUIDED VEHICLES AND VEHICLE LIFTS

(71) Applicant: Park Plus, Inc., Oakland, NJ (US)

(72) Inventor: Andreas N. Wastel, Randolph, NJ (US)

(73) Assignee: Park Plus, Inc., Oakland, NJ (US)

( * ) Notice: Subject to any disclaimer, the term of this patent is extended or adjusted under 35 U.S.C. 154(b) by 0 days.

(21) Appl. No.: 14/565,547

(22) Filed: Dec. 10, 2014

(65) Prior Publication Data

US 2015/0167339 A1 Jun. 18, 2015

Related U.S. Application Data

(60) Provisional application No. 61/914,014, filed on Dec. 10, 2013.

(51) Int. Cl.
*E04H 6/00* (2006.01)
*E04H 6/22* (2006.01)

(52) U.S. Cl.
CPC ..... *E04H 6/22* (2013.01)

(58) Field of Classification Search
USPC ..... 414/241, 246, 260, 239, 234, 254
See application file for complete search history.

(56) References Cited

U.S. PATENT DOCUMENTS 3,756,419 A * 9/1973 Dean ..... 211/13.1
5,328,315 A * 7/1994 Sakamoto et al. ..... 414/236

* cited by examiner

*Primary Examiner* — Saul Rodriguez
*Assistant Examiner* — Willie Berry, Jr.
(74) *Attorney, Agent, or Firm* — Gerald E. Hespos; Michael J. Porco; Matthew T. Hespos

(57) ABSTRACT

A parking system includes parking trays, each of which includes a parking platform for supporting a vehicle thereon and legs depending down from the parking platform. Automated guided vehicles (AGVs) can move between the legs of a tray and then lift the tray with the vehicle thereon for moving the vehicle to or from parking spaces in a parking facility. Each parking space has a vehicle lift device suspended from the ceiling. Each vehicle lift device includes a tray support for supporting the tray and the vehicle thereon. The AGV can move the tray and the vehicle into a position at the parking space so that the tray and the vehicle can be lifted by the vehicle lift device. Thus, another vehicle can be moved into position below the lifted tray and vehicle.

6 Claims, 16 Drawing Sheets

VEHICLE PARKING WITH AUTOMATED GUIDED VEHICLES AND VEHICLE LIFTS

CROSS-REFERENCE TO RELATED APPLICATION

This application claims priority on U.S. Provisional Patent Appl. No. 61/914,014 filed on Dec. 10, 2013, the entire disclosure of which is incorporated herein by reference.

BACKGROUND OF THE INVENTION

1. Field of the Invention

The invention relates to an automated parking facility with automated guided vehicles for moving trays with or without the passenger vehicles thereon and vehicle lifts to permit plural vehicles to be stored in a single space.

2. Description of the Related Art

Municpalities throughout the world continue to grow in size and population density, and the number of vehicles in a municipality varies directly with the population size and density. Most municipalities have zoning ordinances that control the number of parking spaces required for all new construction so that real estate developers provide sufficient parking for residents, tenants employees and customers of new real estate developments. The required number of parking spaces generally is a function of the number of residential units and the square footage of office and retail space.

Suburban real estate developers generally can provide a sufficient number of parking spaces with grade level lots in proximity to the real estate development. Parking garages generally are not required for suburban real estate development and those parking garages that may be required generally do not present complicated design difficulties.

Real estate developments in urban areas are much more likely to require parking garages, and parking garages in urban areas are much more likely to present design problems. For example, profitability of an urban real estate development is a function of the ratio between the size of the lot and the amount of development that can be placed on that lot. Tall buildings are more likely to be profitable, but also require more parking. A parking garage can be built adjacent to the residential, retail or office building. However, the parking garage adjacent to the new construction limits the amount of the site that can be used for developing the residential, retail or office space. As a result, parking garages often are built below the building that will be served by the parking garage. Above grade parking garages are less costly than below grade parking garages. However, above grade parking garages often are aesthetically unattractive and detract from the architectural appearance of the new building. Below grade parking garages are aesthetically more attractive, but can be cost prohibitive, particularly in coastal areas where flooding is a concern.

Municipal ordinances also are likely to control the size of each parking space and the width of parking aisles to ensure that parkers have sufficient room to maneuver into and out of parking spaces and throughout the parking garage.

Real estate developers can request zoning variances in situations where the zoning ordinance is too burdensome for a particular site. However, the real estate developer must demonstrate that an acceptable alternate can be provided to the specific parking requirements established by the zoning ordinance.

Devices have been available for decades to permit two or more cars to be arranged vertically in a single parking space. The typical device of this type has a platform with sufficient structural rigidity to support a vehicle thereon. Piston/cylinder arrangements or pulleys with chains or cables are provided to raise or lower the parking platform with or without the vehicle thereon. The typical parking platform has a sloped entrance ramp that the vehicle negotiates to enter onto the parking platform. An employee of the parking facility then actuates the lift mechanism to elevate the parking platform with the vehicle thereon. Another vehicle then can be driven into the space below the parking platform. Many such parking devices have more than one parking platform and hence permit more than two vehicles to be parked in a vertical array. Examples of parking devices of this type are shown in U.S. Pat. No. 4,772,172 and in U.S. Pat. No. 7,597,521.

Parking lots that rely upon vehicle lift devices require considerable room for the vehicle owner and/or the parking lot operator to maneuver vehicles from the entrance of the facility to the appropriate vehicle lift device. Most parking lots and parking garages that rely upon this technology do not have automated systems for locating the vehicle or for organizing the stacked arrangement of vehicles. As a result, a significant amount of maneuvering is required to park or retrieve a vehicle. These parking systems tend to be very labor intensive and create the potential for minor accidents as the vehicles are being maneuvered by employees of the parking lot.

Recent work by the assignee of the subject invention has related to the use of automated guided vehicles (AGVs) to move vehicles throughout a parking facility. AGVs are highly maneuverable and precisely controllable. Therefore, an AGV is well-suited for moving vehicles in the tightly confined spaces of a parking facility. AGVs typically would be used in combination with parking trays. More particularly, each parking tray may have a generally planar supporting platform on which the vehicle can be parked and legs extend down from the supporting platform to keep the supporting platform and the vehicle thereon in a slightly elevated position. The AGV is dimensioned to move between the legs and under the supporting platform. Elevating mechanisms on the AGV then can be activated to lift the tray and the depending legs slightly from the floor of the parking facility. The AGV then will maneuver the parking tray and the vehicle thereon to an appropriate parking space in the facility. The AGV then may leave the parked car and the tray and move to another location in the parking facility for moving another tray and another vehicle either into or out of the parking facility. The combination of AGVs and parking trays typically will be used with vertical reciprocating conveyors (VCRs) to permit vehicles to be moved between floors of a parking garage. Systems of this type avoid the need to have the parker drive to and from the parking space. Rather, the parker merely deposits the car on a tray at and ingress bay and retrieves the car later from a tray that has been moved to an egress bay. Parking systems of this type also reduce the labor costs associated with having workers move cars through a parking facility and into the parking spot and then having workers retrieve the cars from the designated parking spot. The recent work in connection with parking facilities that use AGVs, parking trays and VRCs can achieve operational efficiencies and some modest space efficient sees in view of the ability of AGVs to maneuver precisely in confined spaces. However, the systems that use AGVs, parking trays and VRCs generally are not expected to achieve large space savings or vastly improved parking densities.

AGVs have not been considered suitable for use with the above-described devices that enable a plurality of vehicles to be arrayed vertically in a single parking space. More particularly, the very low riding AGV that is suitable for a parking facility is not capable of negotiating the ramp that leads onto the parking platform of the prior art lift device. Additionally, the mechanism of the prior art parking lift device generally is actuated by an employee who has driven the car onto the parking platform. As a result, the manual control of the parking lift device would offset labor efficiencies of the AGV Accordingly, an object of the subject invention is to provide a highly automated parking facility that can achieve significant increases in parking density.

SUMMARY OF THE INVENTION

The invention relates to an automated parking system with a parking structure or location that has at least one level, and typically plural levels or floors. The parking structure or location has at least one bay for ingress and/or egress of vehicles. At least one vertically reciprocating conveyor (VRC) is provided for moving vehicles between the access point and a parking floor in the parking structure. The system further includes at least one automated guided vehicle (AGV) that can transport at least one vehicle within the parking structure. The system may also include a plurality of trays, each of which has a parking platform and a plurality of legs depending down from the parking platform so that the parking platform is supported in a sufficiently elevated position to enable the AGV to drive between the legs and under the parking platform of the tray. The AGV is configured to left the tray with the vehicle thereon slightly from the floor of the parking facility so that the AGV and can transport the tray with the vehicle thereon.

The parking structure or location comprises a plurality of parking spaces, each of which has a lift device that preferably is suspended from the ceiling of the parking structure. Each lift device comprises a tray support and a hoist mechanism that preferably includes a motor, pulleys and chains or cables extending from the tray support around the pulleys and to the hoist mechanism. Thus, the hoist mechanism enables the tray support to be moved from a lower position where the tray support is on the floor of the parking facility and an elevated position where the tray support is spaced sufficiently from the floor of the parking facility to enable a vehicle to be driven under the tray support. The tray support preferably is a generally U-shaped structure with two parallel arms having opposite front and rear ends and a transverse beam extending between the rear ends of the arms. The front ends of the arms of the tray support either are not connected to one another or are connected by a thin flat plate material that can rest on the floor. The arms of the tray support are spaced sufficiently apart to enable an AGV to be driven between the arms. Each tray support may have a plurality of brackets disposed to engage the legs of the respective tray. More particularly, the brackets may be formed with sockets or apertures that are configured to nest with the lower ends of the legs of each tray. The sockets or apertures of each tray support may have a tapered entry to ensure efficient guiding of the legs of the tray into the corresponding socket or aperture. Portions of each arm in proximity to the front and rear ends thereof are connected to the chains or cables of the lift device. The hoist mechanism can act on the chains or cables to lift or lower the tray support with or without the tray and the vehicle supported thereon.

The parking system of the invention operates by using the AGV to transport empty trays from the egress bay either to the ingress bay or to a storage magazine near the ingress bay. The empty tray may be deposited in a recess in the ingress bay or the egress bay so that the top parking surface of the tray is substantially flush with the approach surface for a vehicle entering the ingress bay or the exit surface for the vehicle leaving the egress bay. An approaching vehicle is guided by electro-optical signage and/or by audio instructions so that the vehicle can be positioned properly on the tray. The positioning of the vehicle on the tray is assessed by photo-optical sensors in the ingress bay and signage that will guide the driver of the vehicle to a proper stop position at which the vehicle is supported properly on the tray. The driver will exit the vehicle and may receive a receipt that can be used to reclaim the vehicle. The receipt can be a paper or cardboard receipt or an electronic receipt that can be loaded electronically onto a cell phone or other electronic device. Alternatively, the driver can use a credit card and a regular parker may merely use an assigned PIN. The sensors in the ingress bay may be operative for determining when the driver and any passengers have departed the vehicle and the ingress bay. The sensors also may determine the condition of the vehicle so that pre-existing damage can be documented. The tray with the vehicle thereon then is prepared for transport to the VRC. This preparation can include elevating the tray/vehicle combination sufficiently for engagement by an AGV that will transport the tray/vehicle combination to a VRC. Preferably, however, the AGV driving surface in the parking structure may be at the same level as the surfaces in the ingress and egress bays that support the trays. Thus, the AGV merely drives under the trays, lifts the tray and the vehicle thereon with the platform lifts and then transports the tray/vehicle combination from the egress bay toward the VRC. The parking structure can include a queue area between the ingress bay and the VRC for storing the tray/vehicle combinations while waiting for an elevator to become available.

The tray/vehicle combinations are loaded onto a VRC either by the conveyor system or by an AGV, which then leaves the VRC with the tray and the vehicle therein. The VRC then transports the tray/vehicle combination to a selected floor for storing the vehicle. The floor and the storage location are selected and stored by the central controller of the parking facility. The location may be selected based on an intended parking duration or pickup time designated by the driver at the ingress bay. Once at the proper floor, another AGV will move between the legs of the tray and into a position for supporting the tray and the vehicle thereon. The platform lifts of the AGV then will activate to lift the tray sufficiently for the weight of the tray and vehicle to be supported by the AGV with the legs of the tray at a slight distance from the floor. The control unit of the AGV then will control the drive devices to move the AGV with the tray/vehicle combination thereon to the selected location on the floor of the parking structure. In this regard, the motors of the respective drive devices can be operated in accordance with independent instructions received from the control device on the AGV so that the wheels can be powered independently for guiding the AGV along an appropriate route to the selected parking location. Movement of the AGV to the selected parking location is dictated by input received by Hall effect sensors on the AGV upon passing in proximity to magnets on the floor. Alternatively, movement can be guided by embedded wires in the floor of the parking facility or by bar code readers on the AGVs and bar codes on the floor. Hall effect sensors are preferred. In this regard, the information sensed by the Hall effect sensors can be used to adjust the alignment of the AGV, to turn the AGV about an axis perpendicular to the parking floor, to reverse the movement of the AGV and to change the movement from, for example, and X direction to a Z direction.

While the AGV is approaching the selected parking location, the lift device at the selected parking space will lower the tray support, if no vehicle currently is on the tray support or in the parking space. The AGV then will move between the front ends of the arms of the lowered tray support and toward the transverse beam at the rear end of the tray support. The AGV will align the legs of the tray to engage with the sockets or apertures in the brackets that project from the arms of the tray support. The platform lifts of the AGV then will lower so that the legs of the tray will nest with or engage in the sockets or apertures on the respective arms of the tray support. The AGV then may depart from the tray/vehicle combination and may proceed back to the VRC, as guided by the Hall sensor on the AGV and the magnet arrays on the floor. The AGV then may await the next arriving tray/vehicle combination. Alternatively, the AGV may travel to retrieve a vehicle that must be delivered to the egress bay or may remain parked at the parking space to which the vehicle had been delivered. Meanwhile, the lift device at the parking space at which the vehicle had been delivered is activated to lift the tray and the vehicle to an elevated position, thereby freeing the floor surface of the parking space to receive another vehicle therein.

The above described process for parking a vehicle is substantially reversed for retrieving the vehicle. More particularly, an AGV will be guided to the vehicle location by the Hall sensor on the AGV and the magnet arrays on the floor and will move between the legs and under the tray is supported directly on the floor. The platform lifts of the AGV will activate to raise the tray sufficiently for the legs to be spaced slightly from the floor. The AGV then will transport the tray/vehicle combination from the space and either back to the VRC so that the vehicle can be transported to the egress bay for pickup by the driver or to another space so that a previously elevated vehicle can be accessed. In the latter situation, the lift device will lower the tray support with the tray and the vehicle thereon down to the floor. The AGV then we will move between the arms of the tray support from the front end of the tray support toward the rear end. The platform lifts of the AGV then will activate to raise the trays sufficiently for the legs to be separated from the sockets or apertures of the tray support so that the AGV with the tray and the vehicle thereon can be moved from the parking space and toward the VRC.

DETAILED DESCRIPTION OF THE PREFERRED EMBODIMENT

Figure 1:
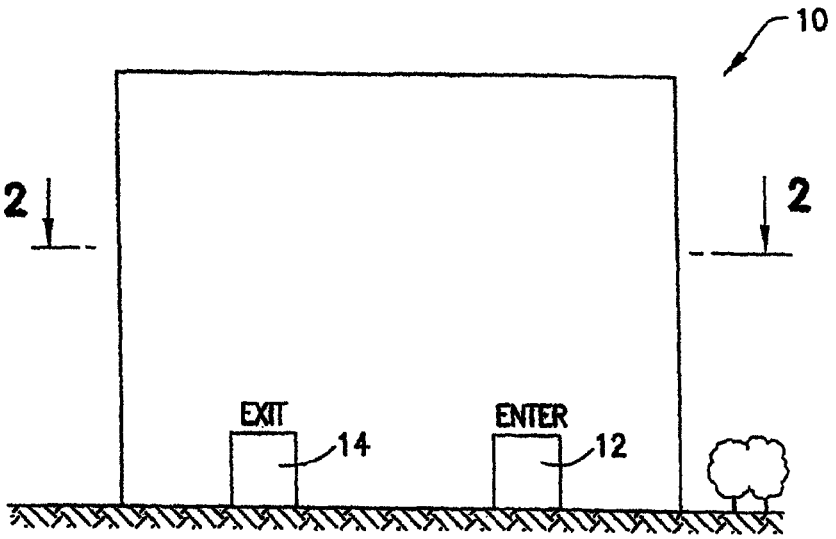
FIG. 1 is a front elevation view of a parking structure that includes the system of the subject invention.
Figure 2:
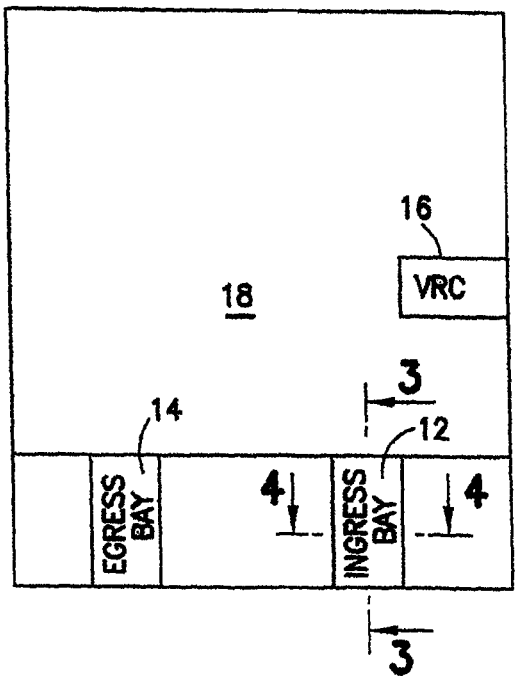
FIG. 2 is a cross-sectional view taken along line 2-2 of FIG. 1, and showing the ground floor where vehicles enter and exit a multi-floor parking facility.

A parking garage in accordance with the invention is identified generally by the numeral 10 in FIGS. 1-5. The parking garage 10 includes an ingress bay 12 and an egress bay 14, each of which is dimensioned to receive an automotive vehicle. At least one vertical reciprocating conveyor (VRC) 16 is disposed in proximity to the ingress and egress bays 12 and 14. Additionally, a queue area 18 is disposed between the ingress bay 12 and the VRC 16 to accommodate vehicles that are waiting for the VRC 16 to become available. Automated doors preferably are provided between the queue area 18 and in the ingress and egress bays 12 and 14 to prevent customers from accessing the queue area 18. The doors to the queue area 18 will be open only after the customer has left the ingress or egress bays 12 and 14. The parking garage 10 further includes a plurality of floors that can be accessed by the VRC 16. Each floor includes a plurality of areas where vehicles can be parked. Each floor has a plurality of magnet arrays 20 affixed to the floor at positions spaced apart, for example, by approximately 10 feet. Each magnet array 20 includes a plurality of magnets 22. The pattern of positive and negative poles of each magnet 22 within each magnet array 20 is specified to define unique addresses or signatures for the magnets 22 and the magnet arrays 20. Each magnet 22 preferably is a thin planar structure attached to a sheet 23 or laminated between two sheets 23. The sheet 23 of their respective magnet array 20 band is affixed to the floor by adhesive or mechanical attachment members at a specified location and in a specified orientation.

The parking system of the invention utilizes a plurality of trays 24, as shown in FIGS. 3, 4, 7 and 8. Each tray 24 includes a substantially rectangular parking platform 26 with a top surface 28 for supporting a vehicle thereon and a bottom surface 29. Legs 30 project down from the parking platform 26 for supporting the parking platform 26 in a spaced position from the floor. The legs 30 may flare outward or inward slightly so that a plurality of parking trays 24 can be nested vertically for storage and transportation.

Figure 3:
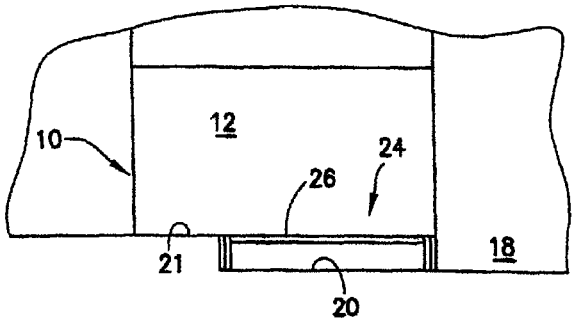
FIG. 3 is a cross-sectional view taken along line 3-3 of FIG. 2.
Figure 4:
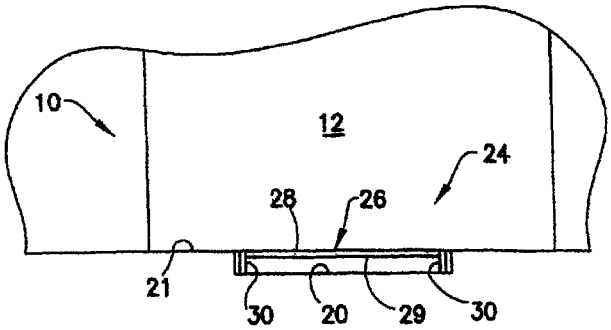
FIG. 4 is a cross-sectional view taken along line 4-4 of FIG. 2.
Figure 5:
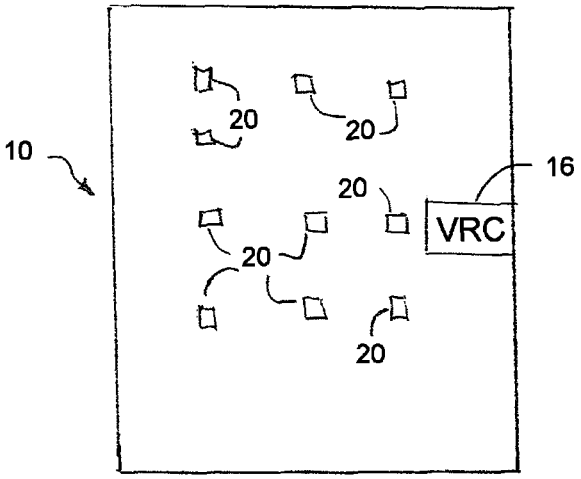
FIG. 5 is a top plan view of a portion of an upper level floor of the parking facility where vehicles are parked, and further showing the magnet arrays on the upper level floor of the parking facility.
Figure 6:
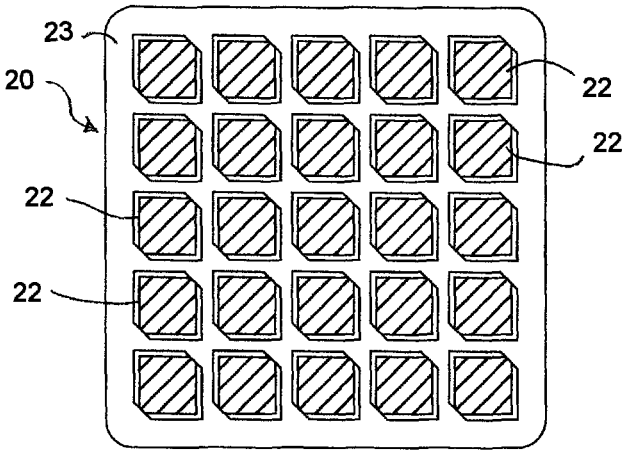
FIG. 6 is a top plan view of one embodiment of a magnet array in accordance with the invention.
Figure 7:
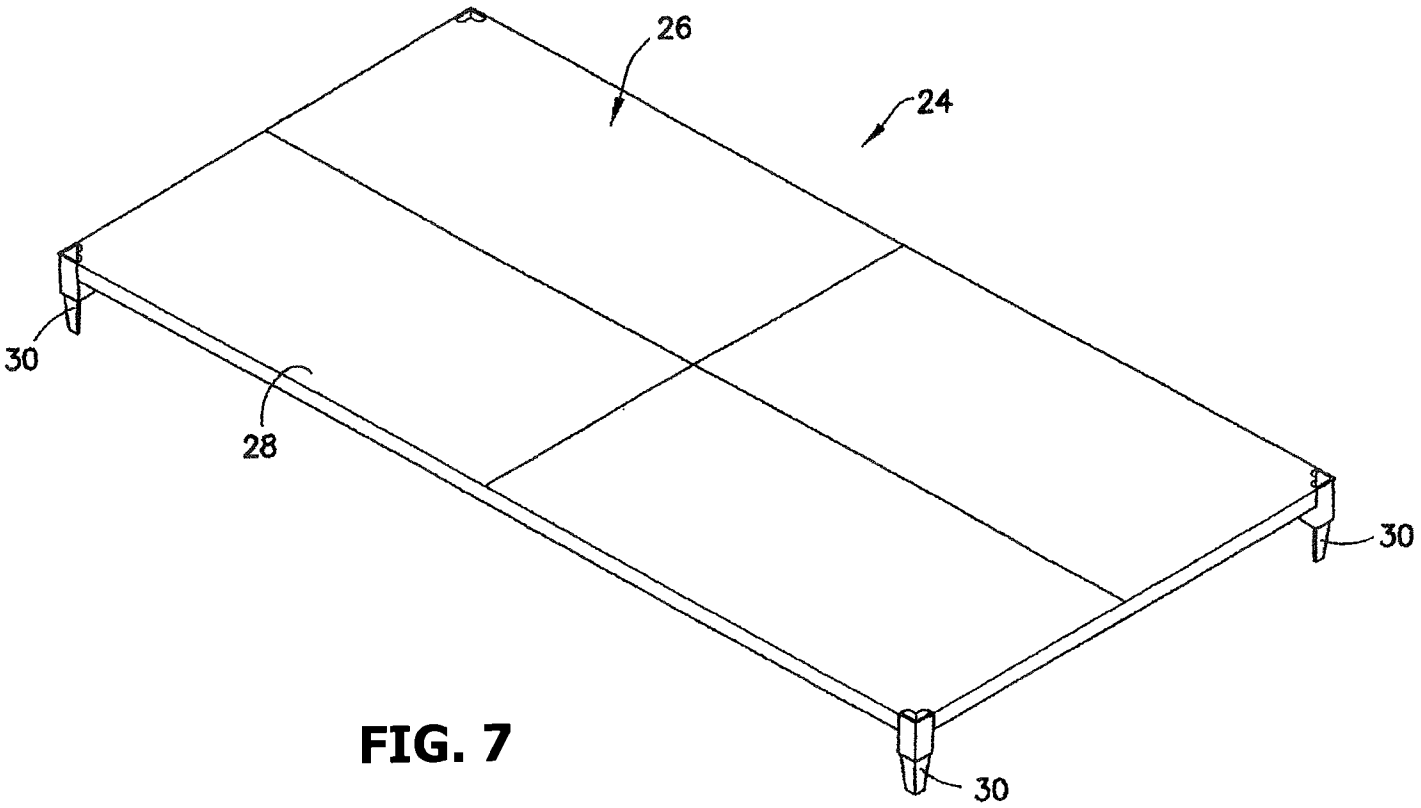
FIG. 7 is a perspective view of a tray in accordance with the invention.
Figure 8:
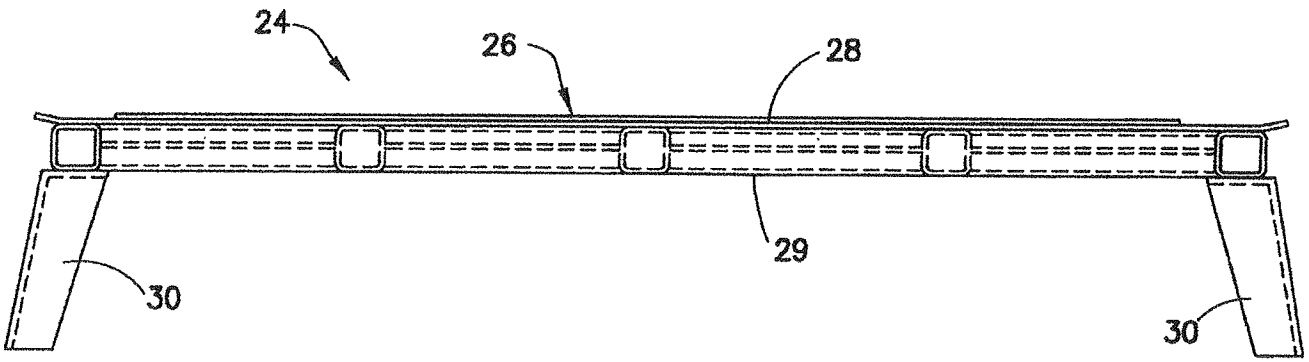
FIG. 8 is a side elevational view of the tray.
Figure 9:
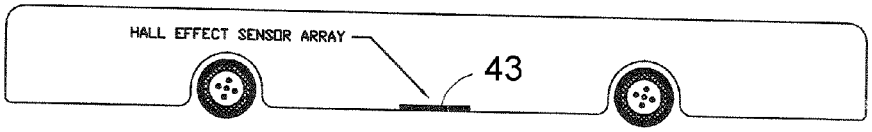
FIG. 9 is a side elevational view of an automated guided vehicle in accordance with the invention.
Figure 10:
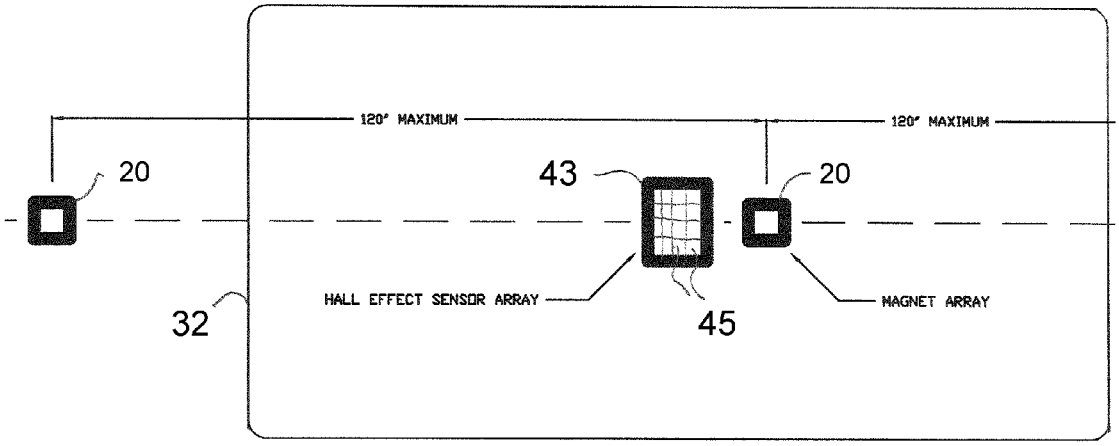
FIG. 10 is a top elevational plan view of the automated guided vehicle on a parking floor and in proximity to two of the magnet arrays.
Figure 11:
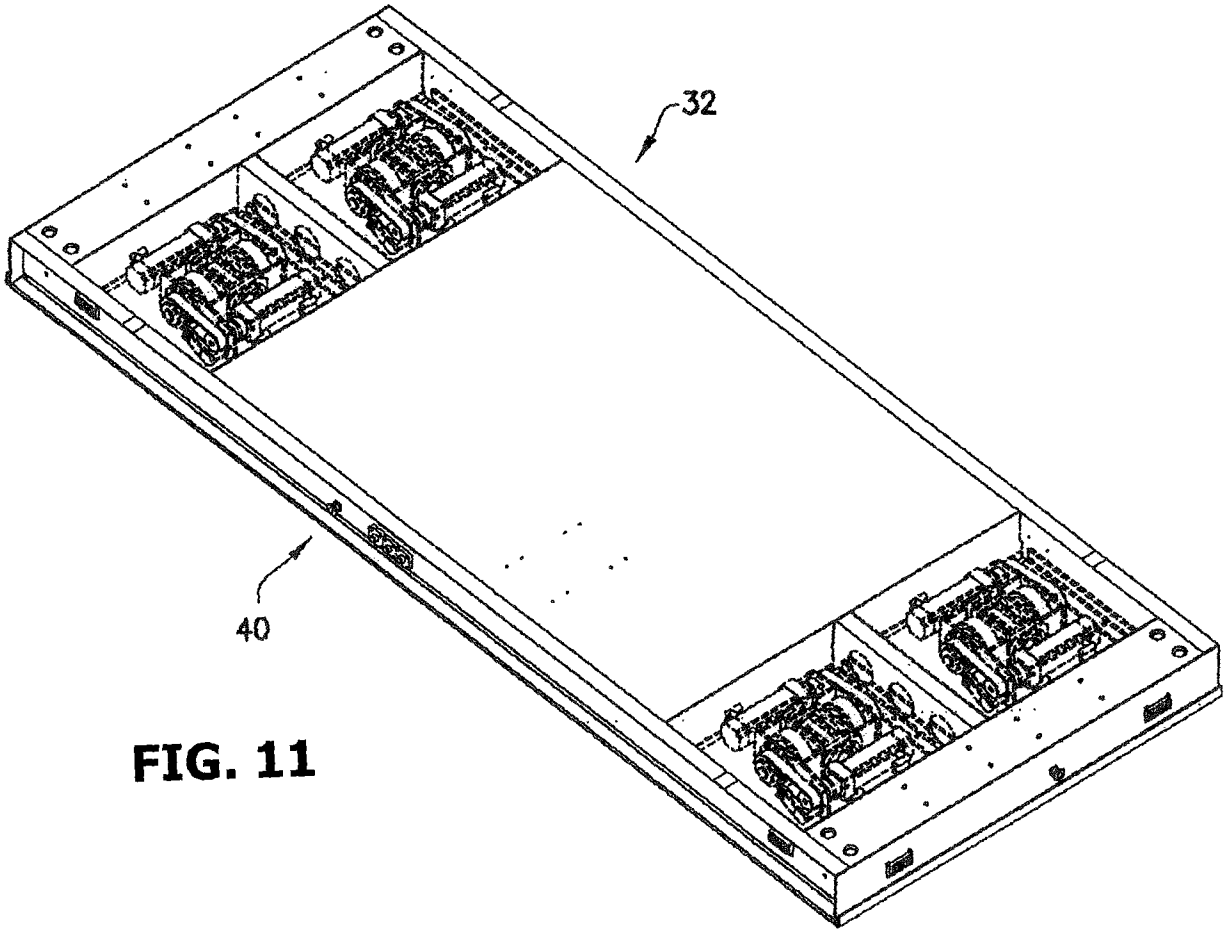
FIG. 11 is a bottom perspective view of the automated guided vehicle of FIG. 9.
Figure 12:
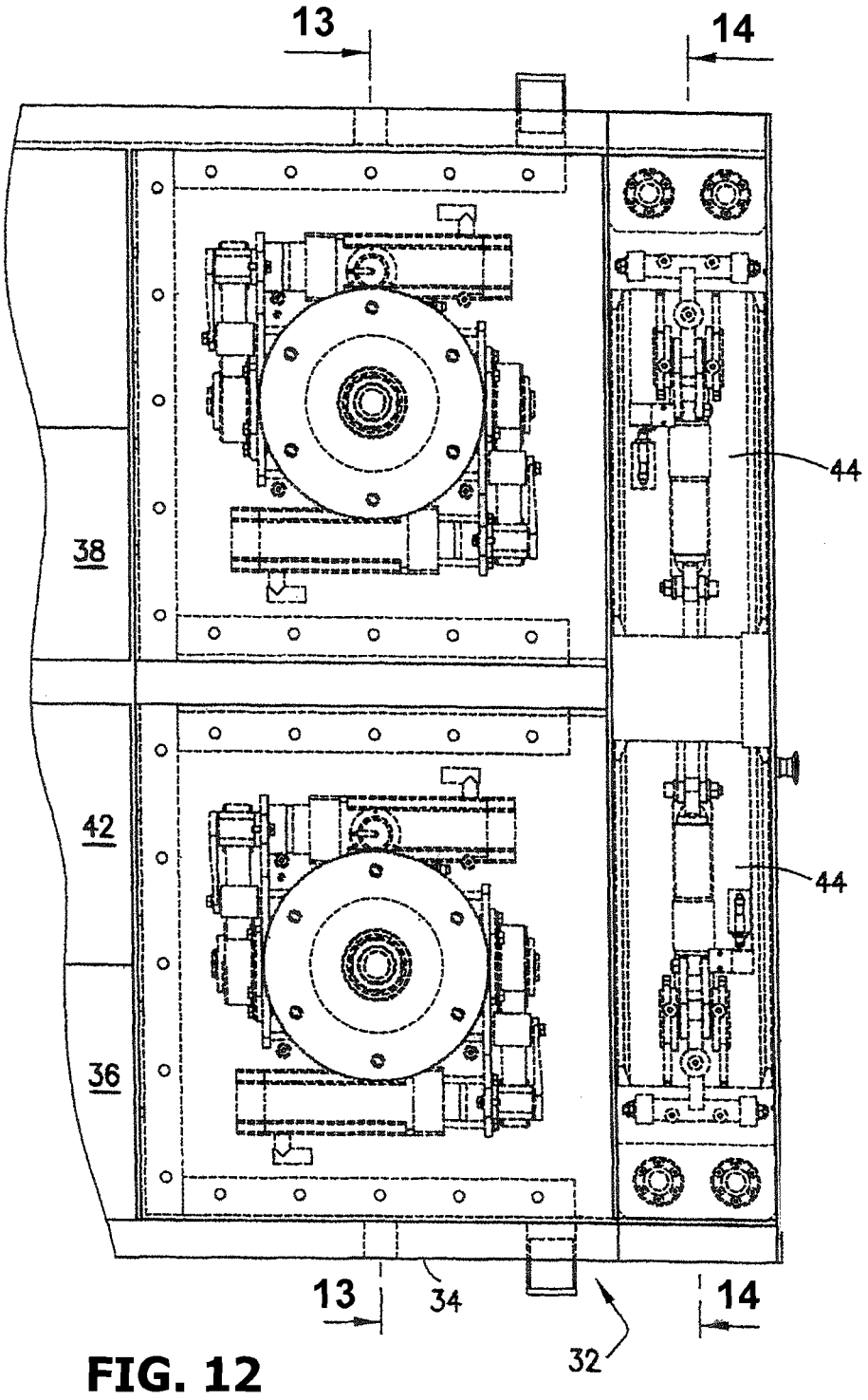
FIG. 12 is a bottom plan view of one end of the automated guided vehicle.
Figure 13:
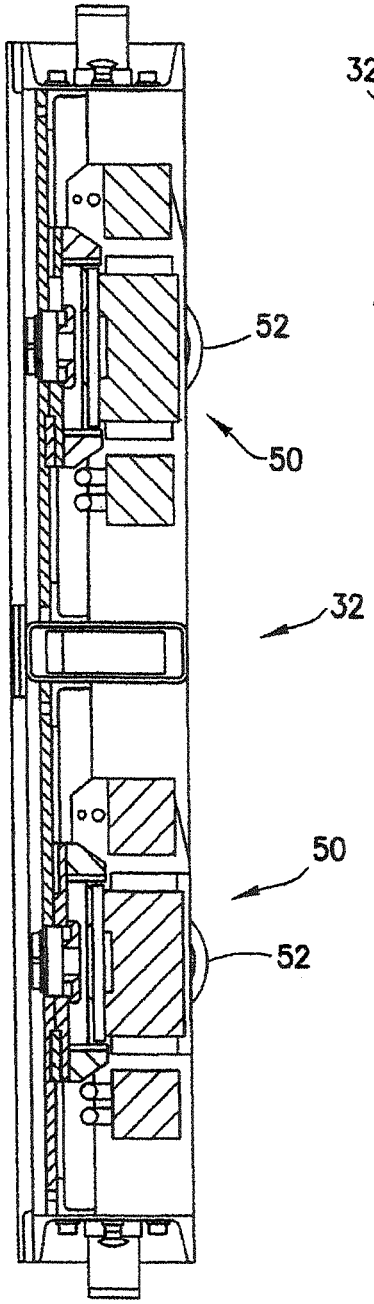
FIG. 13 is a cross-sectional view taken along line 13-13 in FIG. 12.
Figure 14:
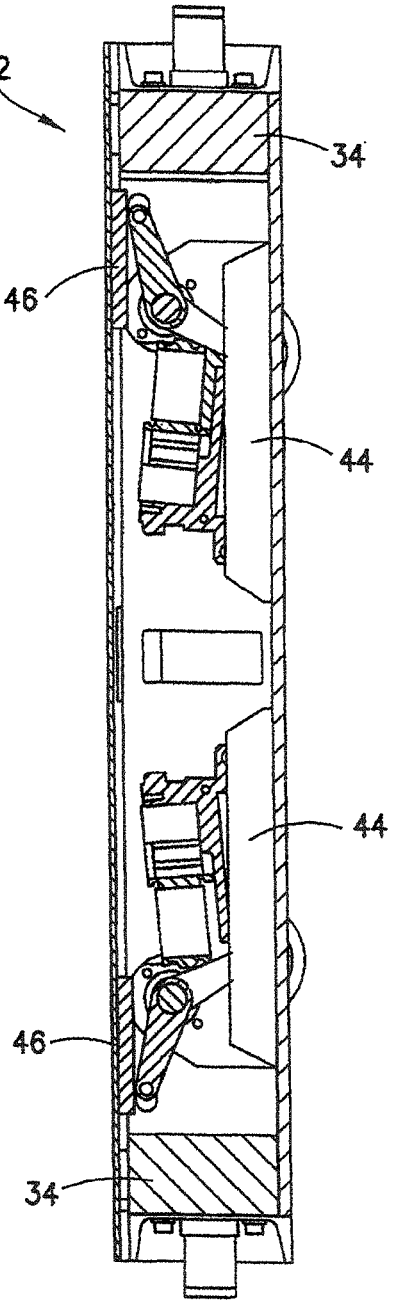
FIG. 14 is a cross-sectional view taken along line 14-14 in FIG. 12.
Figure 15:
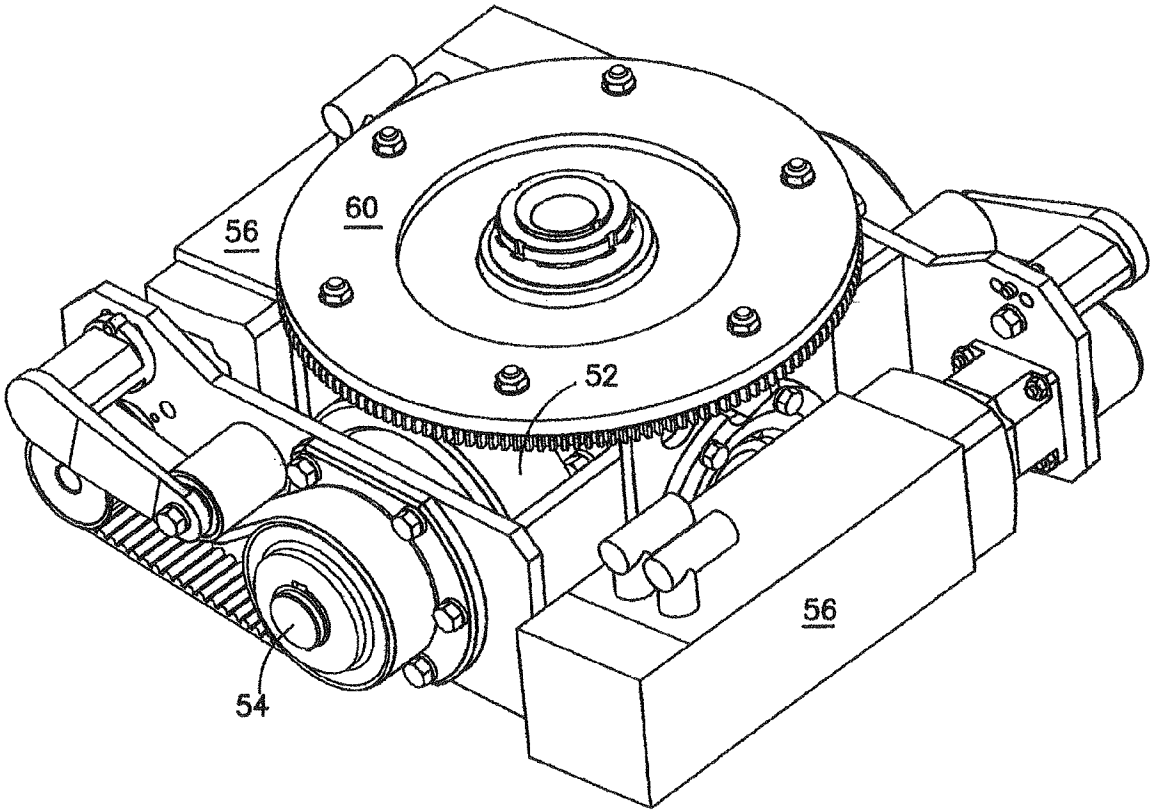
FIG. 15 is a perspective view of a drive device for the automated guided vehicle.
Figure 16:
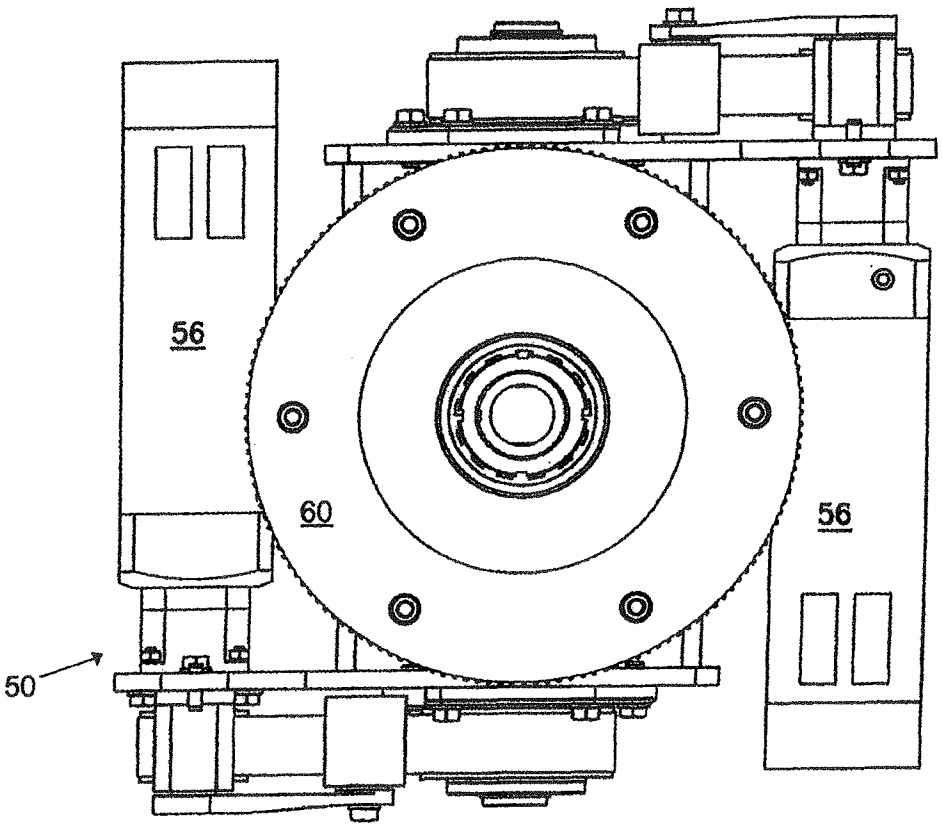
FIG. 16 is a top plan view of the drive device.
Figure 17:
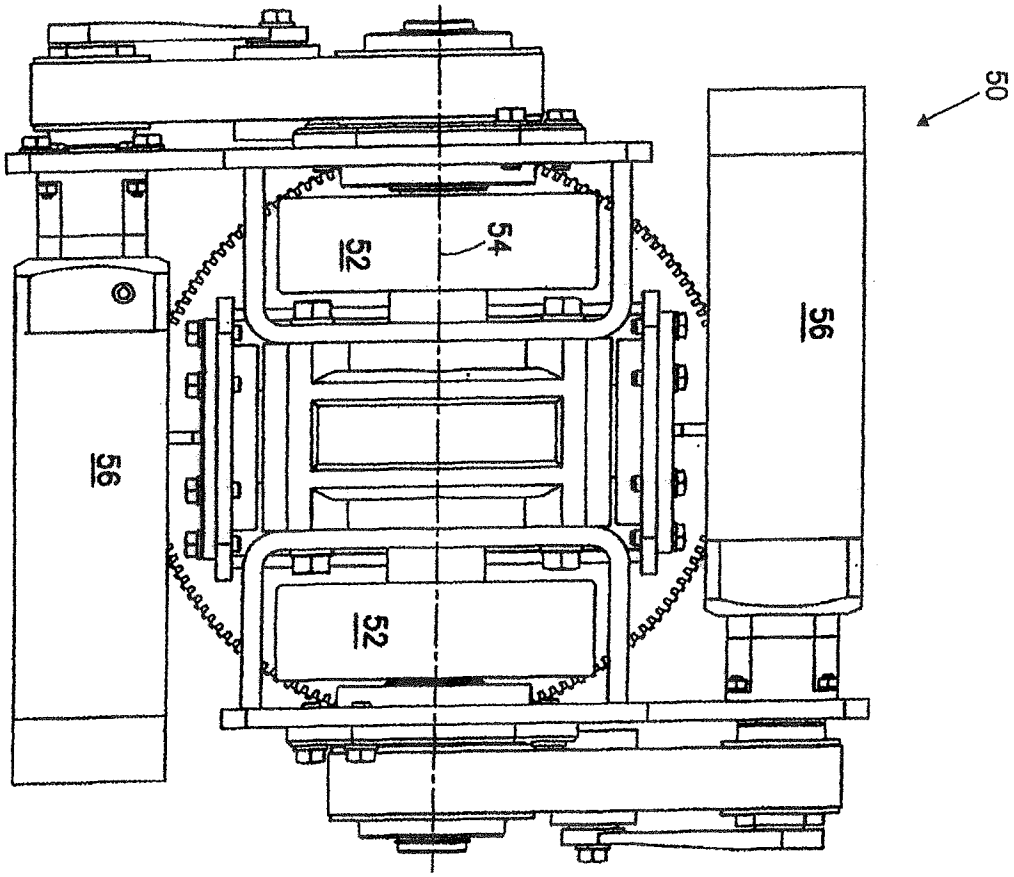
FIG. 17 is a bottom plan view of the drive device.
Figure 18:
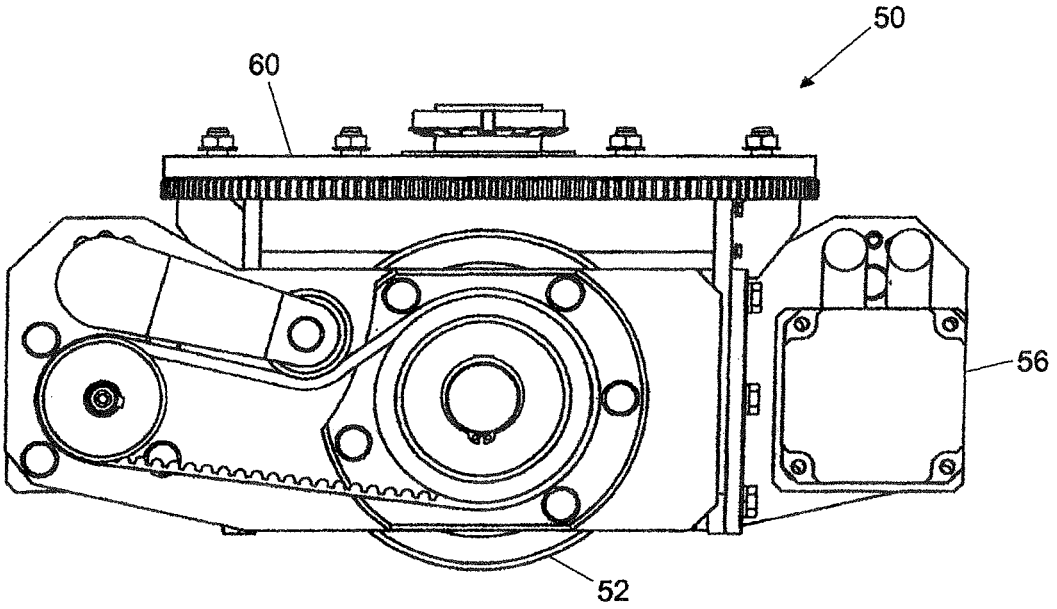
FIG. 18 is a side elevational view of the drive device.

The ingress and egress bays 12 and 14 each include a recessed floor 20 dimensioned to receive one of the trays 24 or a magazine of trays 25, as shown in FIGS. 3 and 4 and as explained further below. The recessed floor 20 is lower than the floor 21 at other locations in the ingress or egress bays 12 or 14 by a distance substantially corresponding to the height of the tray 24 or a height of the magazine. Thus, the top surface 28 of the parking platform 26 will be substantially flush with the floor 21 adjacent the recessed floor 20 when the tray 24 is positioned on the recessed floor 20 in the ingress or egress bay 12 or 14, as shown in FIGS. 3 and 4. As a result, a vehicle that enters the ingress bay 12 can drive across the floor 21 and onto the upper surface 28 of the parking platform 26 of the tray 24. Similarly a vehicle on a tray 24 in the egress bay 14 can drive from the upper surface 28 of the parking platform 26 of the tray 24 onto the floor 21 of the egress bay 14 and out of the parking garage 10. The floor in the queuing area 18 is substantially flush with the floor in the recess 20 as shown most clearly in FIG. 3. At least one movable platform 31 is provided in proximity to the recessed floor 20 in the ingress bays 12 and the egress bay 14 and can be moved between first and second positions. The upper surface of the movable platform 31 is flush with the floor 21 and flush with the upper surface 28 of the parking platform 26 of the tray 24 when the movable platform 31 is in the first position so that a passenger easily can exit or enter the vehicle in the ingress bay 12 or the egress bay 14 by walking across the movable platform 31. The upper surface of the movable platform 31 is displaced sufficiently in the second position so that the space under the tray 24 can be accessed for lifting and moving the tray 24, as explained further herein. The movement of the platform 31 between the first and second positions can be vertical, horizontal or a combination of vertical and horizontal movements.

The parking system of the invention also includes automated guided vehicles (AGV) 32 for transporting the trays 24 throughout the parking garage 10 with or without vehicles thereon, as shown in FIGS. 9-18. Each AGV 32 includes a substantially rectangular frame 34 that includes an interior 36 for accommodating the operative parts of the AGV 32. More particularly, the interior 36 of the frame 34 includes an array of rechargeable batteries 38 for providing power to operate the AGV 32. The batteries 38 communicate with one or more recharging connectors 40 in a peripheral region of the frame 34. Additionally, the interior of the frame 34 includes a controller 42 for controlling the various operative parts of the AGV 32 as explained herein. The controller 42 further includes a transmitter and a receiver for communicating with a central control for the parking garage 10. The interior of the frame 34 of the AGV 32 further includes a Hall effect sensor apparatus 43 that communicates with the controller 42. The Hall effect sensor apparatus 43 includes an array of Hall effect sensors 45 to sense the magnets 22 in each magnet array 20 as the Hall sensors 45 moves into a position opposed to the respective magnets 22 of the corresponding magnet array 20. The number of Hall effect sensors 45 in the Hall effect sensor array 43 can be selected in accordance with the desired sensitivity and the size and complexity of the parking garage 10. In one embodiment, the Hall effect sensor array 43 has 16 rows and 27 columns.

The AGV 32 further includes four platform lifts 44 disposed within the interior 36 of the frame 34. More particularly, two platform lifts 44 are disposed in proximity to each of the respective longitudinal ends of the AGV 32. The two platform lifts 44 at each end of the AGV 32 are connected to a tray support platform 46 that can be raised or lowered relative to the frame 34. At the lowered or retracted position, the tray support platforms 46 are substantially flush with the upper surface of the frame 34. In the raised or extended position, the tray support platforms 46 project slightly above the upper surface of the frame 34. The platform lifts 44 and the respective tray support platforms 46 are used to raise and lower the trays 24 with or without vehicles thereon as explained herein.

The AGV 32 further includes four drive devices 50 disposed at corners of a rectangle and disposed inwardly of the elevator mechanisms 44. Each drive device 50 includes two wheels 52 mounted for rotation about a horizontal axis 54. The two wheels 52 of each drive device 50 are driven respectively by two drive motors 56 so that each wheel 52 has a dedicated drive motor 56. The assembly of wheels 52 and drive motors 56 on each drive device 50 is mounted to a turntable 60 so that the assembly of wheels 52 and drive motors 56 on each of the drive devices 50 can be rotated about a vertical axis. The turntable 60 freely rotatable about a vertical axis and is driven rotatably by the wheels 52 and their respective drive motors 56. The drive motors 56 are operated independently pursuant to signals received from the controller 42 of the respective AGV 32, which in turn is driven by controls of the parking garage.

The longitudinal and lateral dimensions of each AGV 32 enable the AGV 32 to fit between the legs 30 of a tray 24. Additionally, the height dimensions of each AGV 32 enable the AGV 32 to fit beneath the parking platform 26 of the tray 24 when the tray is supported on the legs 30.

In use, a tray 24 will be positioned on the recessed floor 20 in the ingress bay 12 of the parking garage 10 at a position so that a vehicle can drive across the floor 21 of the ingress bay 12 and onto the parking surface 28 of the parking platform 26 of the tray 24. Electro-optical signage in the ingress bay 12 will guide the driver of the vehicle to a proper position on the tray 24. The driver then will exit the vehicle and issue appropriate instructions regarding parking duration and payment method. The instructions may be delivered verbally to an employee of the parking garage 10 or may be delivered electronically, as explained above. The movable platform 31 will move to the second position after the driver and any passengers exit the ingress bay 12. An AGV 32 then will move from the queue area 18 and into the space beneath the parking platform 26 of the tray 24 so that the tray 24 and the vehicle thereon can be raised and moved to the queue area 18 and/or the VRC 16. This process can be carried out in reverse at the egress bay 14. More particularly, an AGV 32 can deliver a tray 24 and the vehicle thereon onto the recessed floor 20 in the egress bay 14. The AGV 32 then will exit the egress bay 14 and return to the queue area 18. The movable platform 31 then will move from the second position to the first position where the upper surface of the movable platform 31 is flush with the floor 21 in the egress bay 14. The driver and any passengers then will be permitted to enter the egress bay 14 so that the vehicle can exit the parking garage 10.

The tray 24 with the vehicle thereon then will be transported to the VRC 16. This transportation between the ingress bay 12 and the VRC 16 can be carried out by any of several optional means. Preferably, an AGV 32 will move beneath the tray 24. The platform lifts 44 of the AGV 32 then will be moved into their extended positions so that the tray 24 with the vehicle thereon is elevated slightly from the floor 20 so that the AGV 32 can transport the tray 24 and the vehicle thereon to the VRC 16. Alternatively, a conveying mechanism can move the vehicle from the ingress bay 12 to the VRC 16.

The VRC 16 will move the tray 24 with the vehicle thereon to a selected floor in the garage 10 for parking. An AGV 32 then will transport the tray 24 and the vehicle to a preselected parking location. More particularly, the AGV 32 will move between the legs 30 of the tray 24 and into a position for properly supporting the tray 24. This accurate positioning can be determined by the Hall sensor 43 on the AGV 32 and the magnet arrays 20 on the floor. The proper positioning of the AGV 32 relative to the tray 24 will be transmitted to the controller 42 of the AGV 32, which will generate a signal to operate the platform lifts 44 of the AGV 32. The platform lifts 44 will cause the tray support platforms 46 to move into the extended position so that the tray 24 with the vehicle thereon is lifted sufficiently for the legs 30 of the tray 24 to be spaced from the floor. The controller 42 of the AGV 32 then will issue appropriate signals for operating the drive devices 50 of the AGV 32. More particularly, the control of the AGV 32 will cause the drive motors 56 to drive the wheels 52 so that the AGV 32 delivers the tray 24 and the vehicle thereon to an appropriate pre-designated parking location. In this regard, the drive motors 56 all can be operated independently of one another pursuant to instructions received from the controller 42. In some instances, the motors 56 on a single drive device 50 will be operated in opposite directions for turning the turntable 60 to steer the AGV 32 in the required direction. The operation of the drive devices 50 will be carried out in coordination with the signals received by the Hall effect sensors 45 on the AGV 32 as the AGV moves over the respective magnet arrays 20. As noted above, the magnets 22 of each magnet array 20 has a unique combination of positive and negative poles so that the Hall effect sensors 45 can identify a particular magnet 22 as the AGV 32 moves the Hall effect sensors 43 over the magnet array 20. The Hall effect sensor array 43 will be able to identify the particular magnet array 20, and hence can determine the specific location of the AGV 32 on the floor of the parking garage 10. Additionally, the Hall effect sensor array 43 will identify the particular magnetic 22 in the magnet array 20 to determine both the position and the alignment of the AGV 32. The magnet array 20 and the Hall effect sensor array can be considered to have rows of magnetics 22 extending in a left to right direction relative to the primary travel direction of the AGV 32 and columns extending in the primary travel direction of the AGV 32. The Hall effect sensor array 43 also has rows and columns of Hall effect sensors 45 will be able to identify the left-right position of the AGV 32 depending upon the particular magnetic 22 in the first row of magnetics in the magnet array 20 that is sensed as the respective Hall effect sensors 45 of the Hall effect sensor array 43 move into a position above the magnetic array 20. If the next magnetic grid 22 sensed by the Hall effect sensor 43 is in the same column, the controller 42 will determine that the AGV 32 is traveling parallel to the columns. However, if the second magnetic 22 sensed by a particular one of the Hall effect sensors 43 is in a different column of the magnet array 20, then the controller 42 will determine that the AGV 32 is moving in a direction skewed with respect to the alignment of the columns of magnetic grids 22. Thus, an appropriate corrective instruction can be issued to the drive devices 50 of the AGV.

Each designated parking space 70 is provided with a vehicle lift device 72 suspended from the ceiling 74 of the parking facility 10. The vehicle lift device 72 includes a motor 76, a general U-shaped tray support 78 and cables or chains 80 extending between the motor 76 and the corners of the tray support 78. The U-shaped tray support 78 includes two parallel arms 82 having opposite front and rear ends 84 and 86 and a transverse beam 88 extending between and the rear ends 86. Brackets 90 project in from the arms 82. The brackets 90 are configured and disposed to engage the legs 30 of a tray 24. The motor 76 preferably is actuated to lower the tray support 78 to the floor of the parking facility 10.

Figure 19:
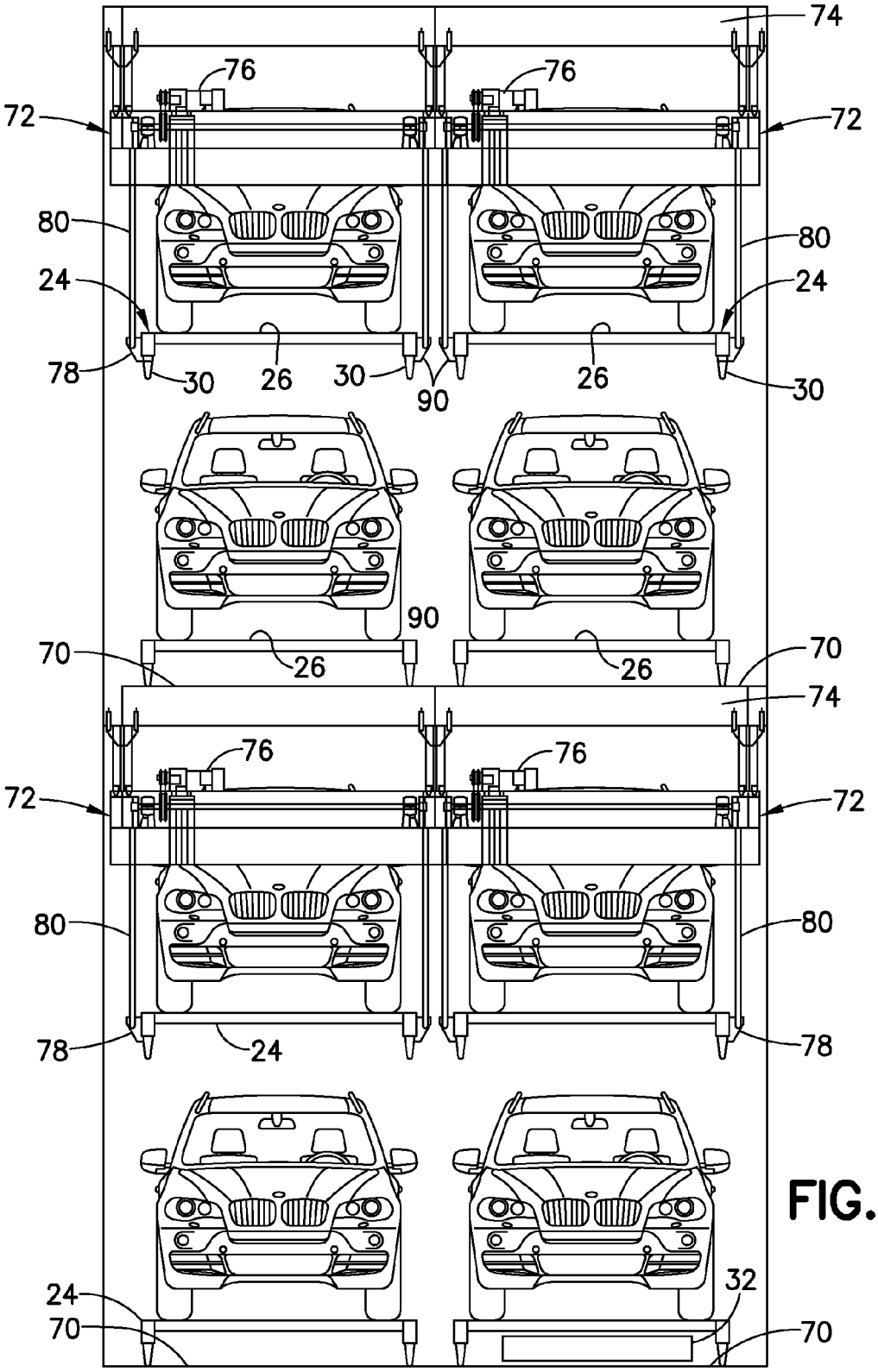
FIG. 19 is a cross-sectional view of a parking facility showing two floors and front elevational views of vehicles parked on those floors.
Figure 20:
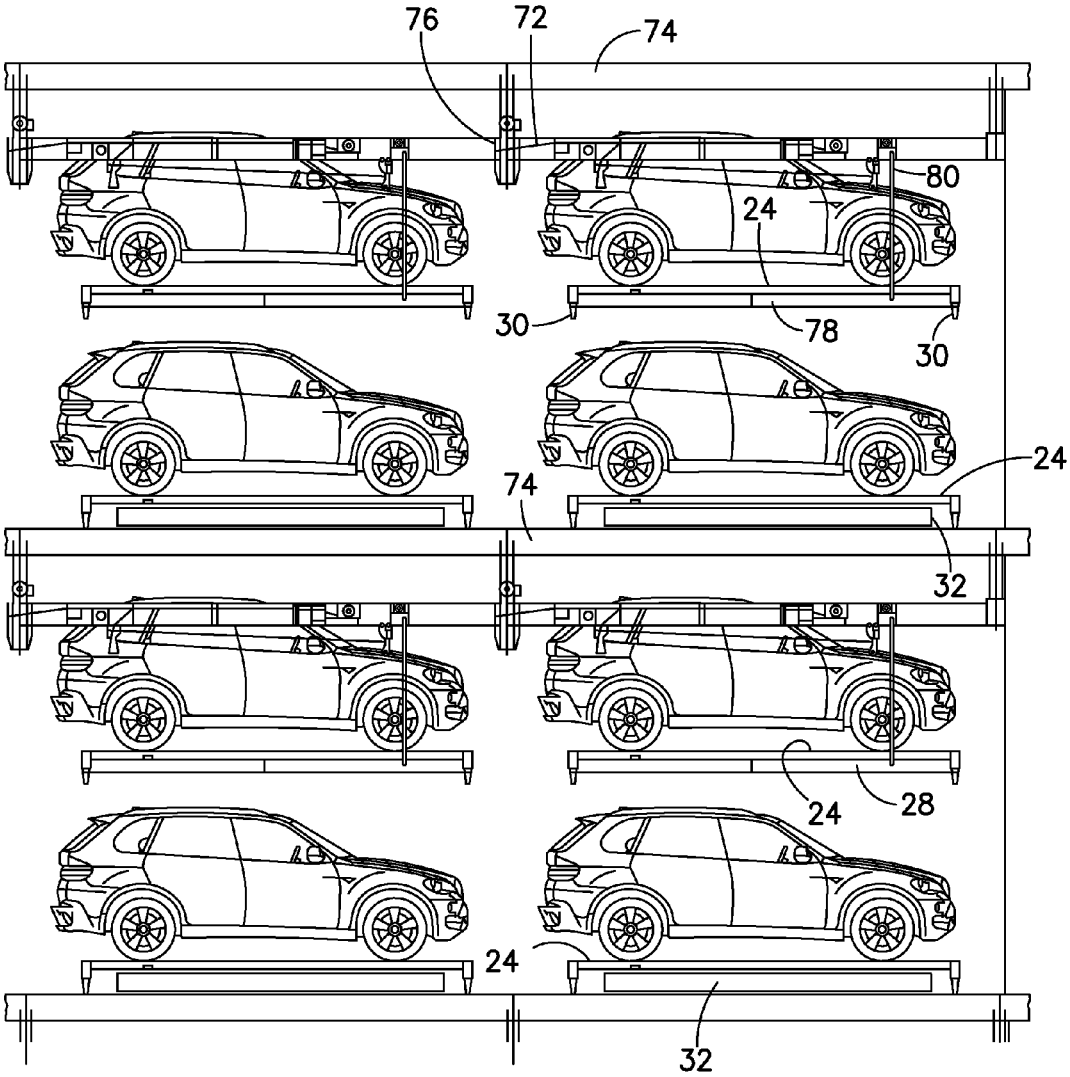
FIG. 20 is a cross-sectional view of the parking facility shown in FIG. 19, but showing the vehicles viewed from the side.
Figure 21:
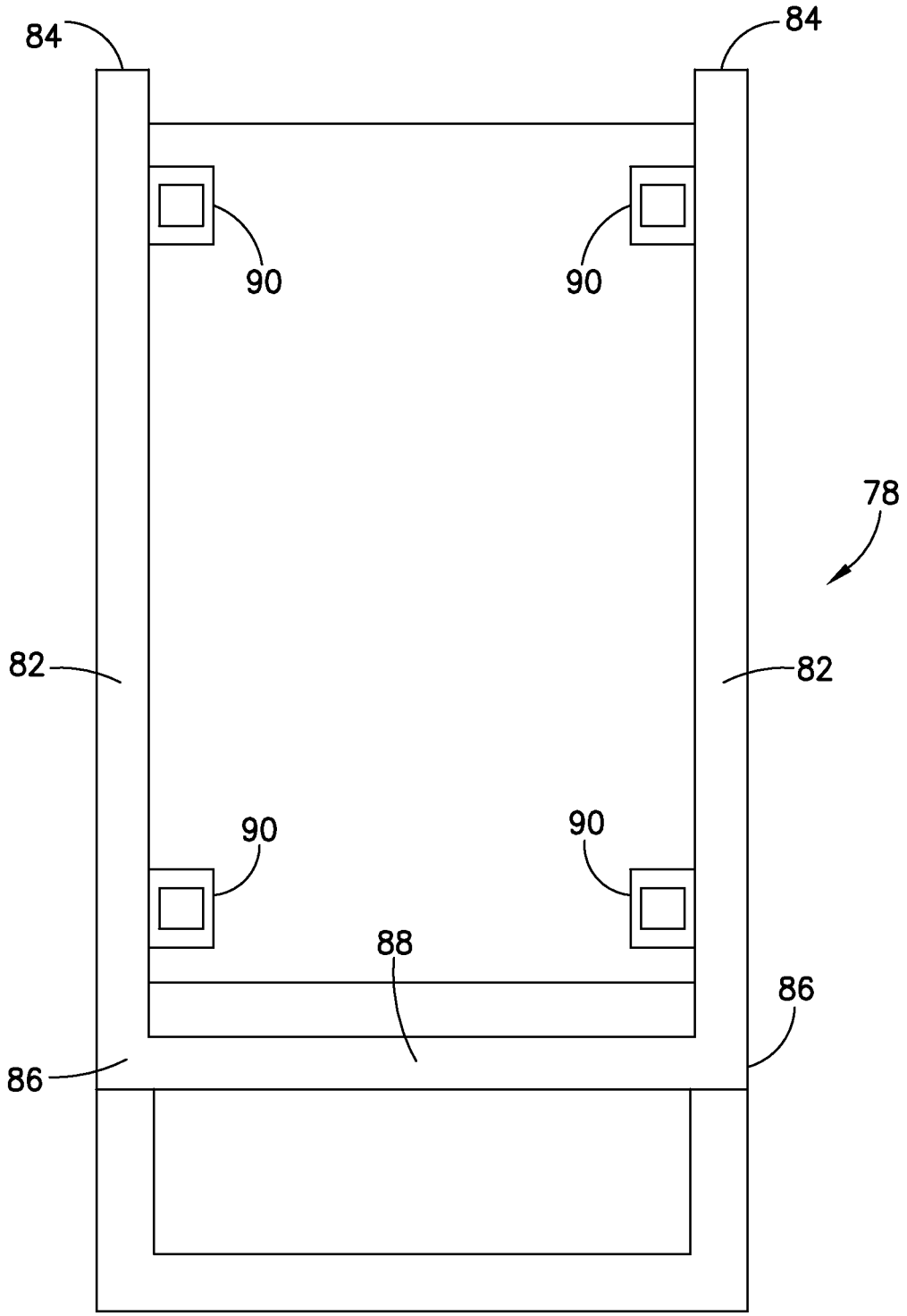
FIG. 21 is a top elevational view of the tray support of the vehicle lift device.

Once at the designated parking location, the controller 42 of the AGV 32 will him cause the AGV to move between the arms 82 of the tray support 78 and into a position where the legs 30 of the tray 24 align with the brackets 90 of the tray support 78. The controller 42 of the AGV 32 then will issue instructions to the respective platform lifts 44 to retract the tray support platforms 46 sufficiently for the legs 30 of the tray 24 to rest on and engage with the brackets 90 of the tray support 78. The controller 42 of the AGV 32 then may operate the drive motors 56 to move the AGV 32 away from the tray 24. The AGV 32 then will be guided to another location by the Hall effect sensor array 43 and the magnet arrays 20 for performing more work, such as returning another tray 24 and the vehicle thereon to the appropriate VRC 16 to have the vehicle delivered to the egress bay 14. The motor 76 of the vehicle lift device 72 then lifts the tray support 78, the tray 24 and the vehicle thereon to the elevated position so that another tray 24 with another vehicle thereon can be moved into the space beneath the tray support 78 as shown in the figures. In each occurrence, the AGV 32 can leave the parking space after depositing the tray 24 and the vehicle so that additional work can be performed by the AGV 32. Alternatively, as shown in FIGS. 19 and 20, the AGV 32 may remain parked temporarily at the parking spot while awaiting an additional assignment.

The invention has been described with respect to certain preferred embodiments. However, other changes within the scope of the invention will be apparent to those skilled in the art after having read this description of the preferred embodiments and the accompanying drawings.

What is claimed is:

1. A parking facility, comprising:

a plurality of trays, each tray having a parking platform for supporting a vehicle thereon and legs depending from the parking platform;

a plurality of parking spaces, each parking space having a vehicle lift device, each vehicle lift device having a tray support with brackets for supporting the legs of the tray;

at least one automated guided vehicle dimensioned to move between the legs of the tray and operative to lift the tray and the vehicle thereon, each automated guided vehicle further having at least one drive mechanism for moving the trays and the vehicles in the parking facility, the automated guided vehicle being configured to deposit the tray with the vehicle thereon on the vehicle lift device so that the vehicle lift device can elevate the tray and the vehicle sufficiently to permit another vehicle to be located under the tray.

2. The parking facility of claim 1, wherein the tray support of the vehicle lift device is substantially U-shaped and has two parallel arms, each of which has opposite front and rear ends, a transverse beam connecting the rear ends of the arms, the automated guided vehicle being dimensioned to move between the arms from the front end toward the rear end.

3. The parking facility of claim 1, wherein the vehicle lift devices are suspended from a ceiling of the parking facility.

4. A parking facility, comprising:

at least one substantially horizontal floor and at least one ceiling opposed to the floor;

a plurality of trays, each of the trays having a parking platform for supporting a vehicle thereon and legs depending from the parking platform so that the parking platform is spaced from the floor when the legs are supported on the floor;

a plurality of parking spaces on the at least one floor, each of the parking spaces being configured to permit one of the trays to be moved substantially horizontally along the at least one floor and into the respective parking space, each of the parking spaces having a vehicle lift device, each of the vehicle lift devices having a tray support with brackets for supporting and lifting one of the trays and the vehicle thereon toward the ceiling;

at least one automated guided vehicle dimensioned to move between the legs and beneath the parking platform of any one of the trays and operative to lift the tray and the vehicle thereon from the floor, the at least one automated guided vehicle further having at least one drive mechanism for selectively moving the trays and the vehicles along the at least one floor in the parking facility, the automated guided vehicle being configured to deposit the tray with the vehicle thereon on the vehicle lift device at a selected one of the parking spaces so that the vehicle lift device can elevate the tray and the vehicle on the tray at the selected one of the parking spaces sufficiently toward the ceiling to permit another one of the trays with another vehicle thereon to be located under the tray that has been elevated toward the ceiling.

5. The parking facility of claim 4, wherein the tray support of the vehicle lift device is substantially U-shaped and has two parallel arms, each of which has opposite front and rear ends, a transverse beam connecting the rear ends of the arms, the automated guided vehicle being dimensioned to move between the arms from the front end toward the rear end.

6. The parking facility of claim 4, wherein the vehicle lift devices are suspended from the ceiling of the parking facility.

* * * * *